US012416478B1

(12) United States Patent
Shattuck et al.

(10) Patent No.: US 12,416,478 B1
(45) Date of Patent: Sep. 16, 2025

(54) REMOTE EXPLOSIVE SEPARATION TOOL

(71) Applicant: The United States of America Represented by the Secretary of the Navy, Indian Head, MD (US)

(72) Inventors: Michael Shattuck, Port Royal, VA (US); Daniel Mccarthy, La Plata, MD (US); Lee Foltz, Indian Head, MD (US); Adam Pegouske, White Plains, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 18/933,116

(22) Filed: Oct. 31, 2024

(51) Int. Cl.
*F42B 33/06* (2006.01)

(52) U.S. Cl.
CPC ..... *F42B 33/06* (2013.01)

(58) Field of Classification Search
CPC ..... F42B 33/06; F42B 33/067; F42D 5/04
USPC ..... 86/50; 89/1.13
See application file for complete search history.

(56) References Cited

U.S. PATENT DOCUMENTS 3,054,349 A * 9/1962 Plumley ..... F42B 33/06 102/306
3,109,369 A * 11/1963 Plumley ..... F42B 3/00 86/1.1
3,117,518 A * 1/1964 Porter ..... F42B 3/08 102/307
5,210,368 A * 5/1993 Heller, Jr. ..... F42B 33/06 42/84
6,363,828 B1 * 4/2002 Sherlock ..... F42B 33/06 42/51
6,453,788 B1 * 9/2002 Lebet ..... F41H 11/12 89/1.13
6,490,957 B1 * 12/2002 Alexander ..... F41B 11/71 102/275.11

(Continued)

FOREIGN PATENT DOCUMENTS

JP 2005233459 A * 9/2005 ..... F42B 33/06

OTHER PUBLICATIONS

Li Yinliang et al, "Experimental Research on Linear MLEFP Damage Element Intercepting High-speed Penetrator", 2023.: Conf. Ser. 2460 012048.

(Continued)

*Primary Examiner* — Joshua E Freeman
(74) *Attorney, Agent, or Firm* — Fredric J. Zimmerman

(57) ABSTRACT

Exemplary embodiments of apparatus and methods for remotely and explosively cutting the casing of a UXO and separating the fuzing components from the main charge in the UXO. A remote explosive separation tool creates a Linear Explosively Formed Projectile (LEFP) charge to separate fuzing components from live explosive threats in UXO, for example only, a 155 mm artillery round. The tool functions by explosively deforming a copper liner into a linear projectile or penetrator which then impacts the UXO casing. The speed of impact enables the fuzing elements of the UXO to be removed from the main charge of the UXO either by directly cutting the fuze elements off or by imparting the fuze elements with enough momentum such that they break off. The process of dismembering the fuze elements occurs without detonating the main charge of the UXO. The tool may be remotely placed by an unmanned vehicle.

20 Claims, 15 Drawing Sheets

(56) References Cited

U.S. PATENT DOCUMENTS

| | | | | |
|---|---|---|---|---|
| 6,546,838 | B2 * | 4/2003 | Zavitsanos | C06B 33/00 89/1.13 |
| 6,802,237 | B1 * | 10/2004 | Jones | F41H 11/18 89/1.13 |
| 7,836,811 | B1 * | 11/2010 | Gardner | F41A 27/24 180/9.1 |
| 8,813,651 | B1 | 8/2014 | Hooke | |
| 9,303,961 | B1 * | 4/2016 | Frericks | F42B 1/032 |
| 11,022,410 | B2 * | 6/2021 | Lumley | F42B 1/032 |
| 11,187,512 | B1 * | 11/2021 | Foltz | F42B 33/06 |
| 2008/0121097 | A1 * | 5/2008 | Rudakevych | F42D 5/04 901/1 |
| 2011/0061521 | A1 * | 3/2011 | Gardner | F41A 23/56 89/1.13 |
| 2014/0062754 | A1 * | 3/2014 | Mohamadi | F41H 11/16 89/1.13 |
| 2014/0224101 | A1 * | 8/2014 | Benson | F42B 1/02 86/50 |
| 2015/0219427 | A1 | 8/2015 | Alford et al. | |
| 2022/0074712 | A1 * | 3/2022 | Oh | F42D 5/04 |

OTHER PUBLICATIONS

Website: Tactical Electronics, Alford Technologies Limited, the Dioplex device. https://www.tacticalelectronics.com/product/dioplex, 2024.
Website: Explosives, Alford Technologies Limited, UK Vulcan device. https://www.explosives.net/vulcan, 2024.
Website: Explosives, Alford Technologies Limited, UK Tekton device. https://www.explosives.net/tekton, 2024.

* cited by examiner

REMOTE EXPLOSIVE SEPARATION TOOL

STATEMENT OF GOVERNMENT INTEREST

The invention described herein may be manufactured and used by or for the Government of the United States of America for Governmental purposes without the payment of any royalties thereon or therefor.

The invention relates in general to Explosive Ordnance Disposal (EOD) and in particular to apparatus and methods to render, remotely, safe Unexploded Ordnance (UXO) by remotely penetrating the UXO and separating the fuzing components from the main charge in the UXO.

BACKGROUND OF THE INVENTION

UXO may be rendered safe by separating the fuzing components from the main charge in the UXO. FIG. 1 is a partially cutaway schematic of an embodiment of an unexploded 155 mm projectile 100. Projectile 100 may include a base 110, a steel casing 120, an explosive charge 130, fuze components 140, and a fuze well having a bottom 150. If the fuze components 140 are separated from the main charge 130, the separated fuze components may explosively function or still be unexploded and not safe to handle. However, the separated fuze components 140 cannot set off the main charge 130 and cause further hazard. For UXO projectiles such as the 155 mm explosive projectile 100, it is necessary to penetrate or cut into the steel casing 120 of the projectile below the bottom 150 of the fuze well to separate, effectively, the fuze components 140 from the main charge 130.

Conventional technologies may use manually placed charges for penetrating the steel casing of a projectile. Manual placement of these penetrating charges may be very dangerous because of the risk of the UXO exploding and injuring or killing any nearby humans.

A need exists for apparatus and methods to remotely and securely cut through a UXO projectile casing and separate the fuzing components from the main charge in the UXO.

SUMMARY OF THE INVENTION

One aspect of the invention is a remote explosive separation tool for forming a Linear Explosively Formed Projectile (LEFP). The remote explosion separation tool may include a housing having an open front, two opposing side walls, a rear wall, and top and bottom walls. A quantity of C-4 explosive may be packed in the housing. A linear concave copper liner may be disposed in the housing adjacent to the quantity of C-4 explosive. The linear concave copper liner may face the open front of the housing and have an elliptical cross-section. A pair of parallel stand-off wands may extend from respective opposing side walls of the housing. The pair of parallel stand-off wands may include, at distal ends, visual indicators for identifying a point of impact of the LEFP. A base may be attached to the bottom wall of the housing. The base may be configured to contact a ground surface and stably support the tool so that the tool does not tip over prior to detonation of the quantity of C-4 explosive. An unmanned vehicle interface may be attached to the top wall of the housing for attaching the tool to an unmanned vehicle grip.

The remote explosive separation tool may include a pair of wand holder sleeves located on the respective opposing side walls of the housing. Proximal ends of the pair of parallel stand-off wands may be disposed in respective ones of the pair of wand holder sleeves. A proximal end of each stand-off wand may include a barb that contacts the rear surface of the housing.

The base of the remote explosive separation tool may be one of a flat static stand, an angled static stand, and an articulating stand. The unmanned vehicle interface may include an unmanned vehicle grip for one of an inline ground robot, a sideways ground robot, and an unmanned aerial vehicle.

In another aspect, a method of separating fuzing components from a main charge in unexploded ordnance (UXO) may include providing the remote explosive separation tool of the first aspect of the invention. A Linear Explosively Formed Projectile (LEFP) may be created from the linear concave copper liner having the elliptical cross-section. The LEFP may be directed at the UXO. Using the LEFP, the fuzing components may be separated from the main charge without setting off or detonating the main charge.

The method may include transporting the remote explosive separation tool to a location near the UXO, using an unmanned vehicle. The method may include using the unmanned vehicle to aim the remote explosive separation tool at the UXO. The UXO may have a steel casing that is penetrated by the Linear Explosively Formed Projectile (LEFP).

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

Disclosed herein are exemplary embodiments of apparatus and methods for remotely and explosively cutting the casing of a UXO and separating the fuzing components from the main charge in the UXO. A remote explosive separation tool creates a Linear Explosively Formed Projectile (LEFP) that may separate fuzing components from live explosive threats in UXO, for example, a 155 mm artillery round. The remote explosive separation tool functions by explosively deforming a copper liner into a linear projectile or penetrator (as opposed to a jet from a shaped charge) which then impacts the UXO casing at a speed in the range of about 5000 feet per second to about 7000 feet per second. In an exemplary embodiment, the impact speed of the LEFP is about 6000 feet per second. The speed of impact enables the fuzing elements of the UXO to be removed from the main charge of the UXO either by directly cutting the fuze elements off or by imparting the fuze elements with enough momentum such that they break off. The process of dismembering the fuze elements occurs without setting off or detonating the main charge of the UXO. The tool may be remotely placed by, for example, a ground robot or an unmanned aerial vehicle.

Figure 1:
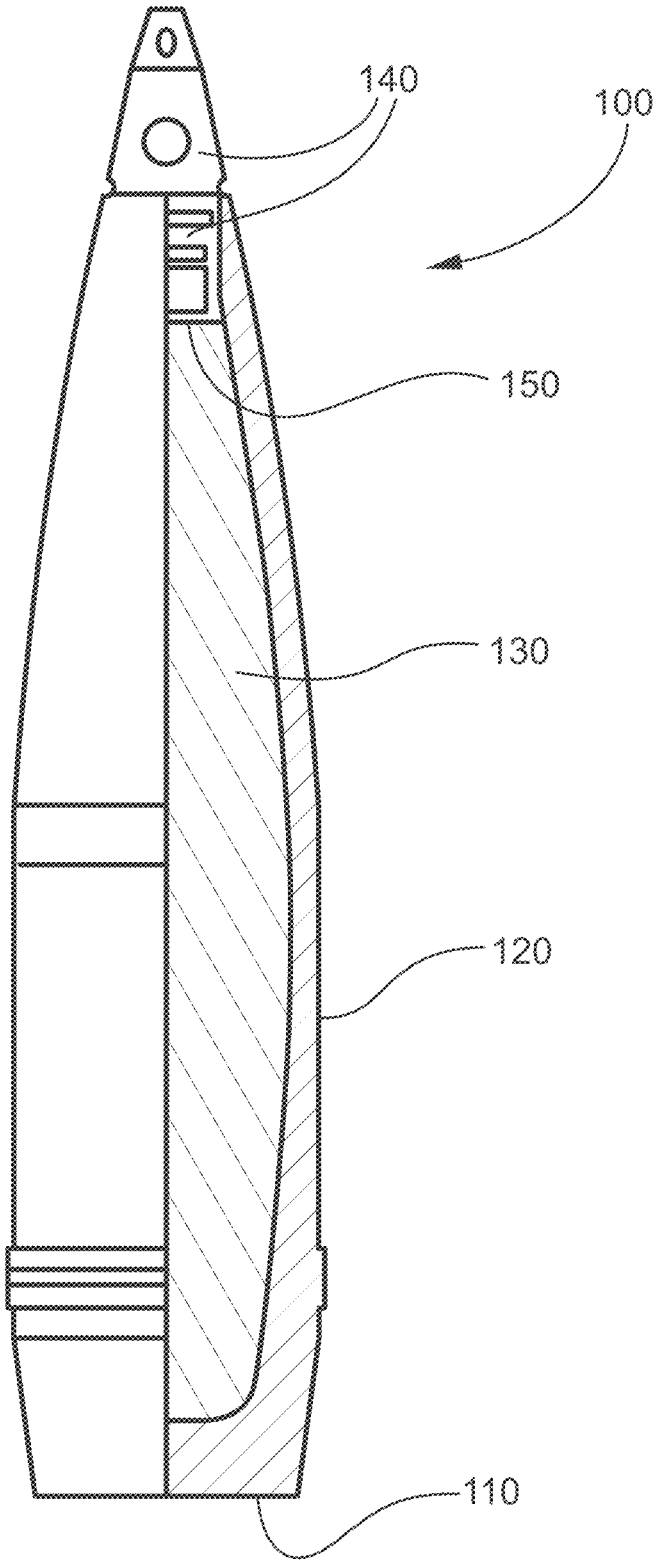
FIG. 1 is a schematic, partially in section, of an embodiment of a conventional 155 mm projectile.
Figure 2:
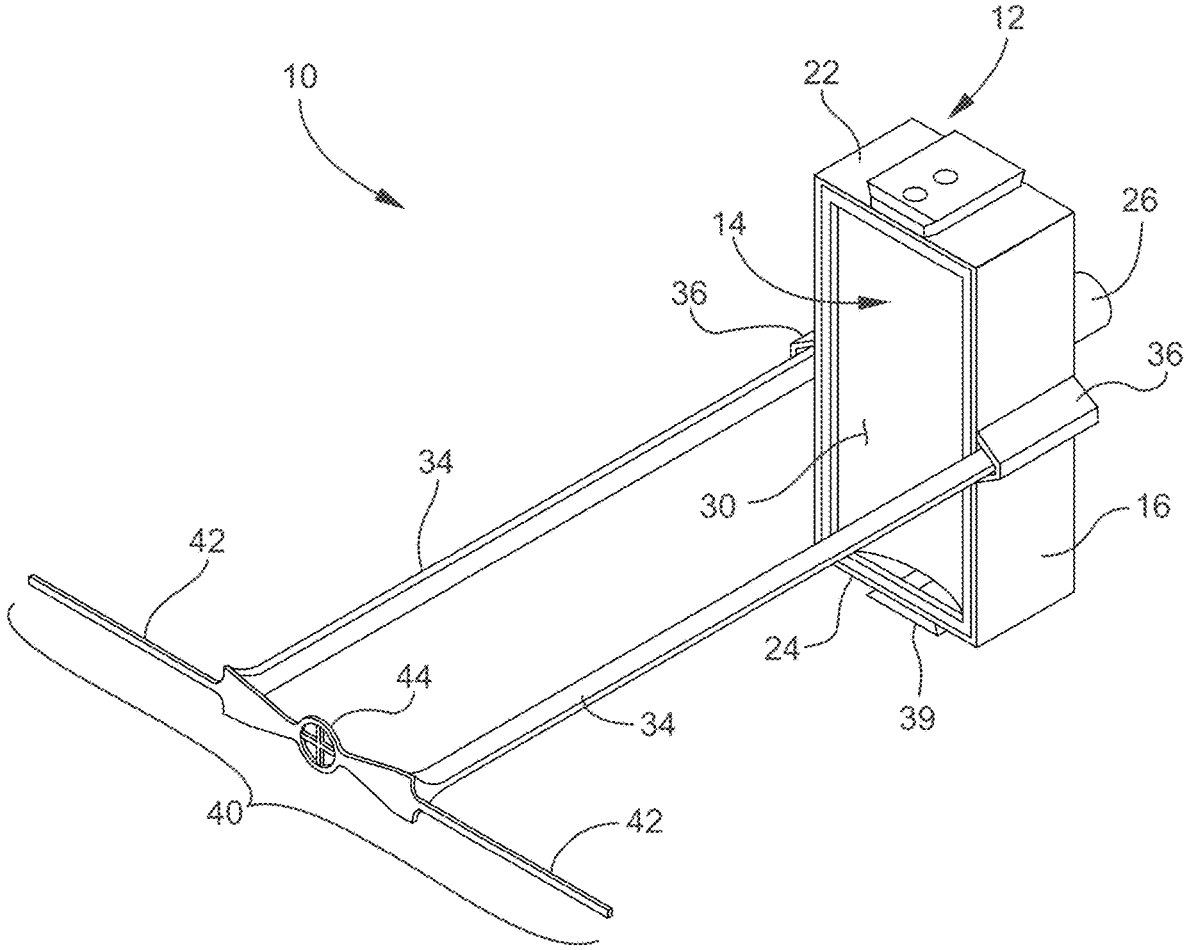
FIG. 2 is a perspective view of an exemplary embodiment of a remote explosive separation tool.
Figure 3:
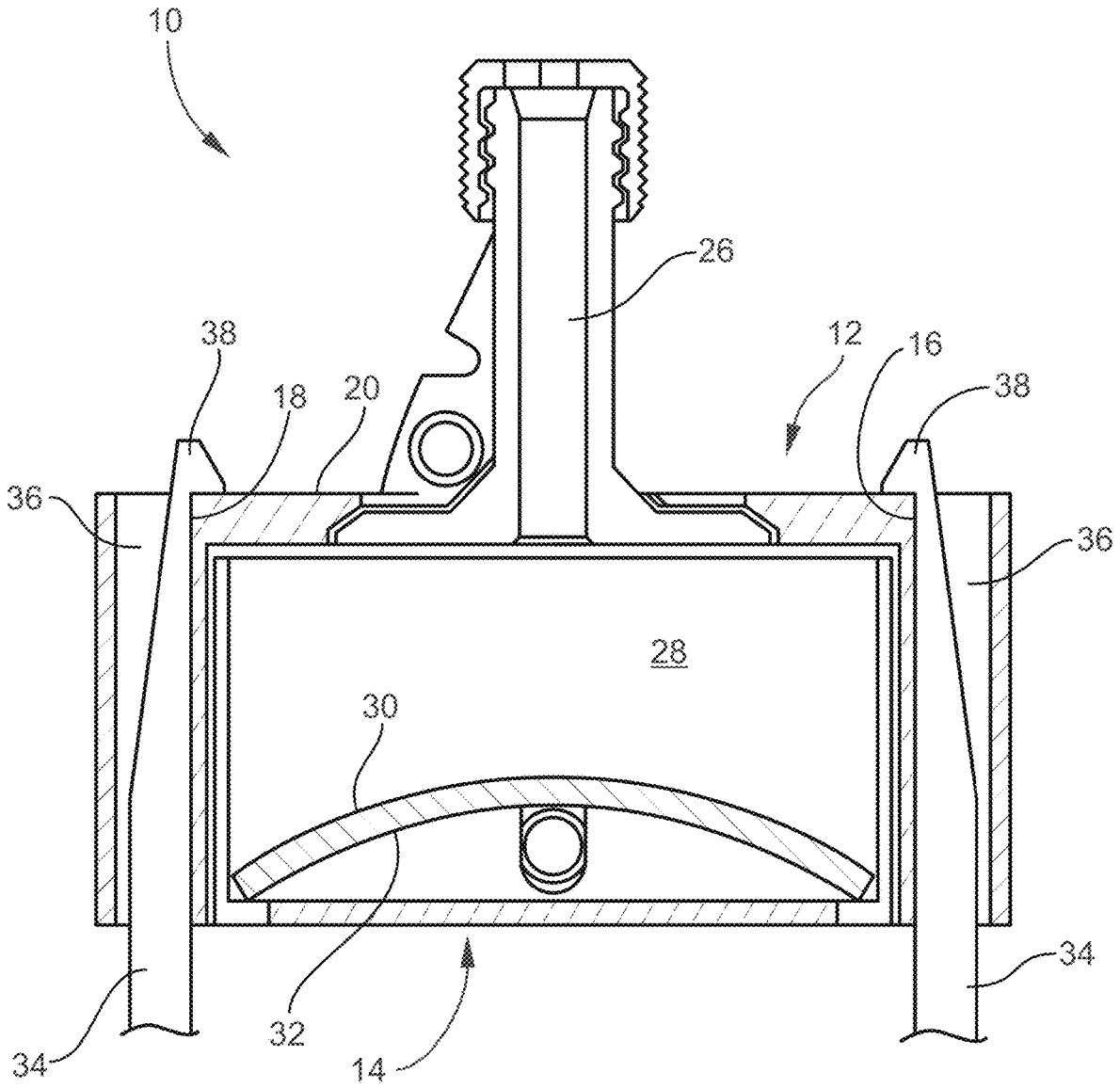
FIG. 3 is transverse cutaway view, partially in section, through a portion of the tool of FIG. 2.

FIG. 2 is a perspective view of one embodiment of a remote explosive separation tool 10 (hereinafter "tool"). FIG. 3 is transverse cutaway view through a portion of the tool 10 of FIG. 2. The tool 10 may include a housing 12 in the shape of a rectangular prism. The housing 12 may be made of, for example, plastic. The housing 12 may be printed by a 3D printer. The housing 12 may have an open front 14; two opposing side walls 16, 18; a rear wall 20; and top and bottom walls 22, 24. A detonator well 26 for holding a detonator (not shown) may be located on the housing 12, for example, on the rear wall 20. The detonator may be initiated in a variety of known ways, including wirelessly. A quantity of C-4 explosive 28 may be packed in the housing 12. In one embodiment, the quantity of C-4 explosive 28 may be, for example, about 1.25 pounds. Other embodiments may use other quantities of C-4 explosive 28. The C-4 explosive 28 may extend from the top wall 22 to the bottom wall 24. A linear concave copper liner 30 may be disposed adjacent to the quantity of C-4 explosive 28. The linear concave copper liner 30 may extend from the top wall 22 to the bottom wall 24. The linear concave copper liner 30 may face the open front 14 of the housing 12. The linear concave copper liner 30 may have an elliptical profile or cross-section 32, as opposed to the circular profile commonly used in explosively formed projectiles. The LEFP forms a solid "blade-like" projectile that experiences minimal break-up at stand-off, thereby allowing the tool 10 to be used at long stand-offs (at least 4 charge diameters) compared with a linear shaped charge (1 charge diameter).

A pair of parallel stand-off wands 34 may extend from respective opposing side walls 16, 18 between the top and bottom walls 22, 24. The wands 34 may extend from the midpoints of the opposing side walls 16, 18. A pair of wand holder sleeves 36 may be located on respective opposing side walls 16, 18. Proximal ends of the pair of parallel stand-off wands 34 may be disposed in respective ones of the pair of wand holder sleeves 36. The pair of parallel stand-off wands 34 may extend perpendicular to the plane of the open front 14. Barbs 38 at the proximal ends of the wands 34 may bear against the rear wall 20 of the housing 12 to help maintain the position of the wands. Distal ends of the wands 34 may include visual indicators 40 for identifying a point of impact of the LEFP and for help in remote placement of the tool 10 by an unmanned vehicle. The visual indicators 40 may include whiskers 42 and a reticle 44. The reticle 44 may indicate the central point of impact of the LEFP, which may correspond to a projection of the geometric center of the open front 14 of the housing 12 to a point that is midway between the distal ends of the stand-off wands 34. The stand-off wands 34 enable the tool 10 be placed at the optimal distance from a target, without measurement, at the time of remotely placing the tool. The optimal distance may vary depending on the target so wands 34 having different lengths may be used.

Figure 4:
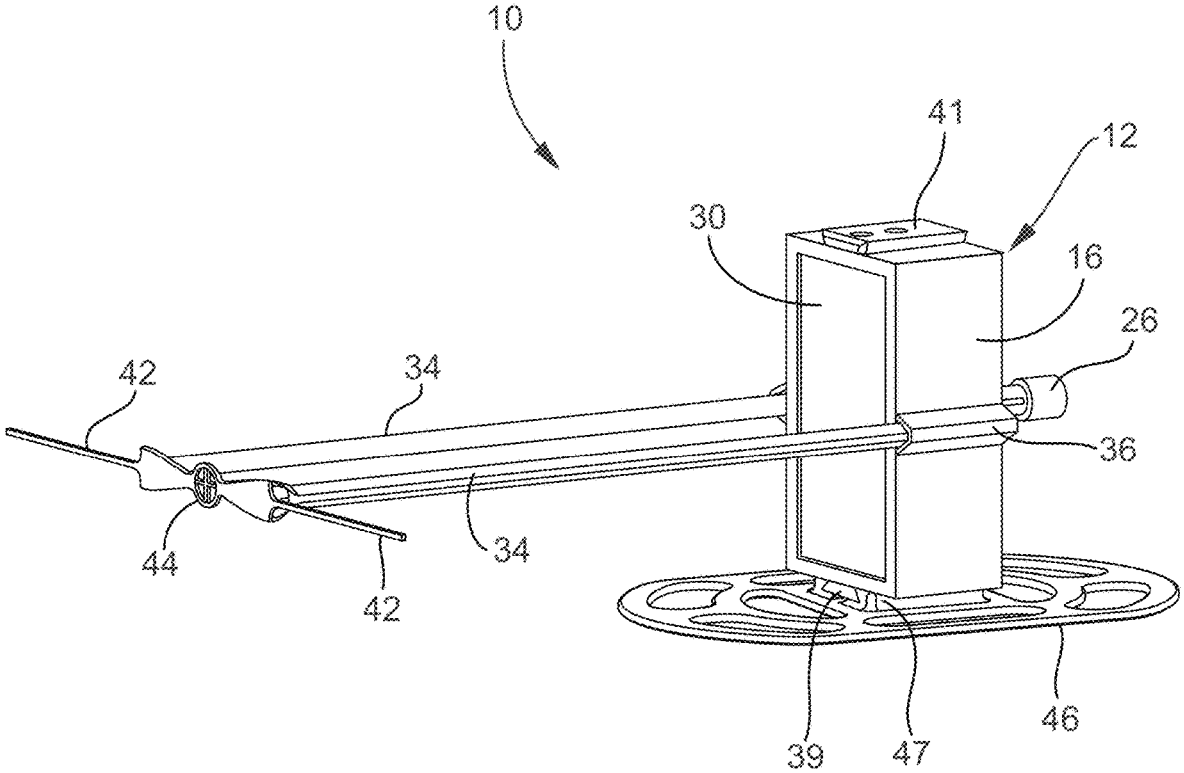
FIG. 4 is a perspective view of the tool of FIG. 2 with an exemplary embodiment of a flat static base.
Figure 5:
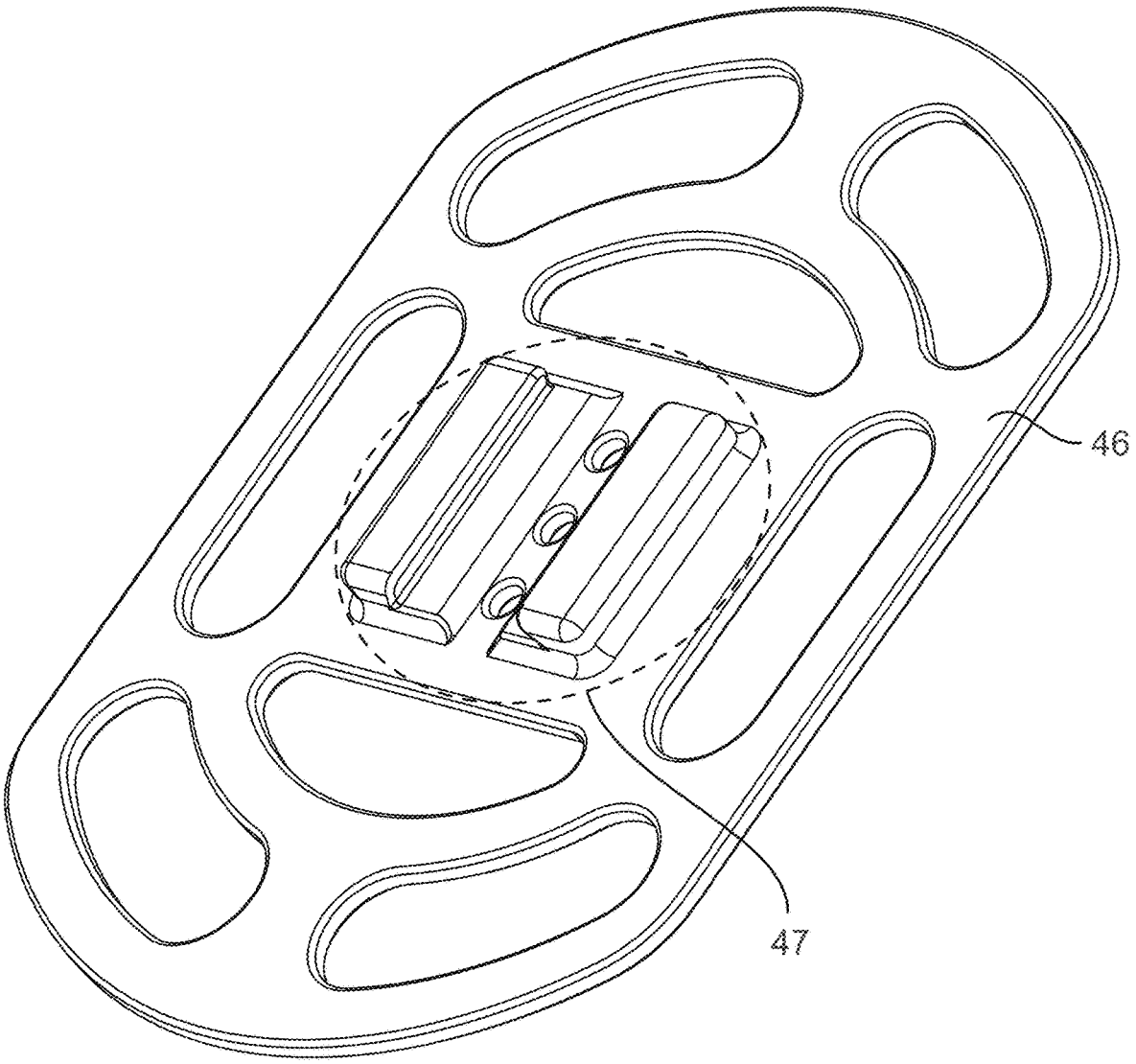
FIG. 5 is a perspective view of the flat static base of FIG. 4.
Figure 6:
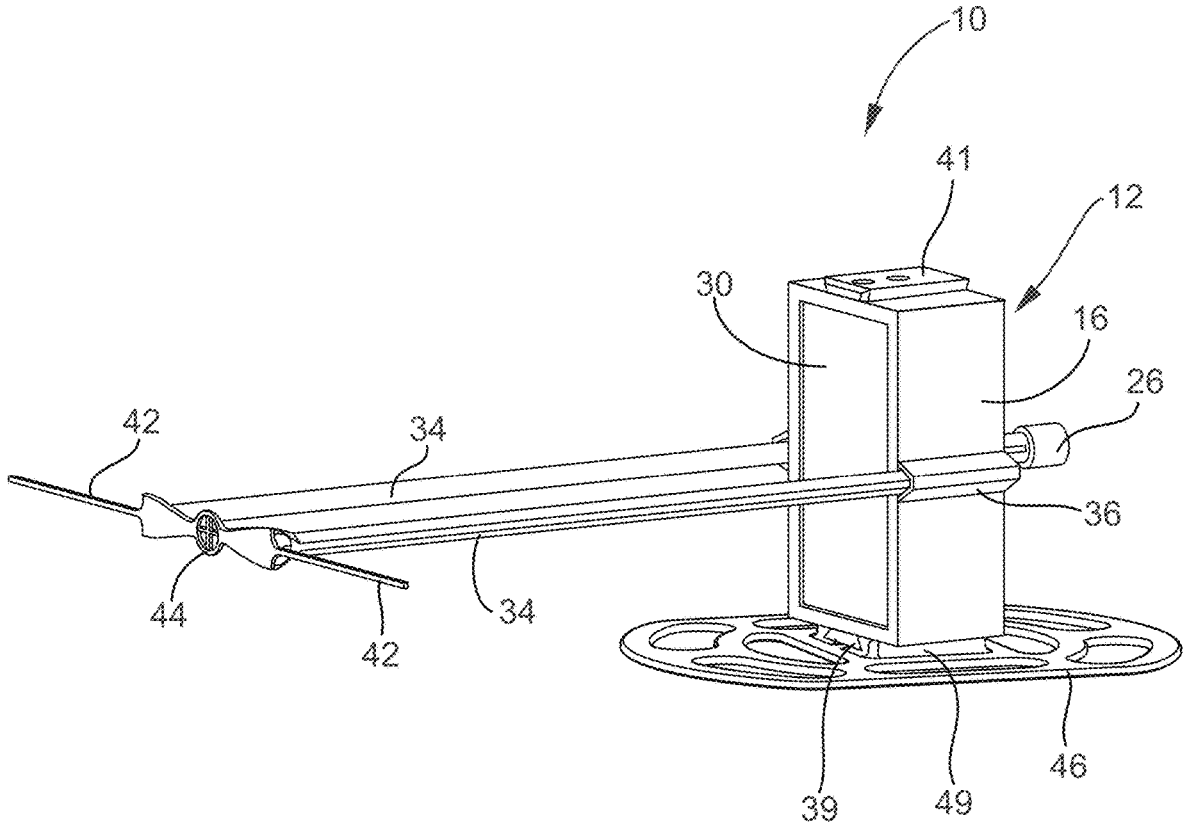
FIG. 6 is a perspective view of the tool of FIG. 2 with an exemplary embodiment of an angled static base.
Figure 7:
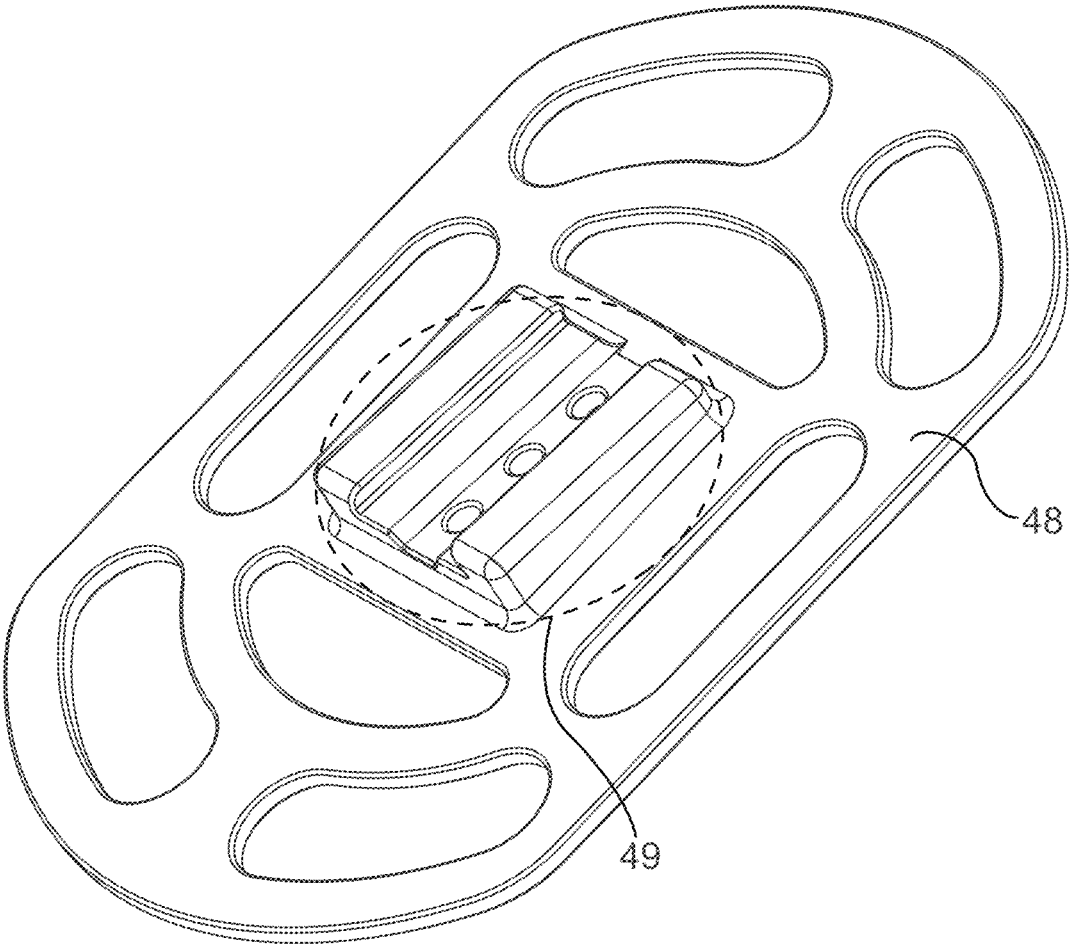
FIG. 7 is a perspective view of the angled static base of FIG. 6.
Figure 8:
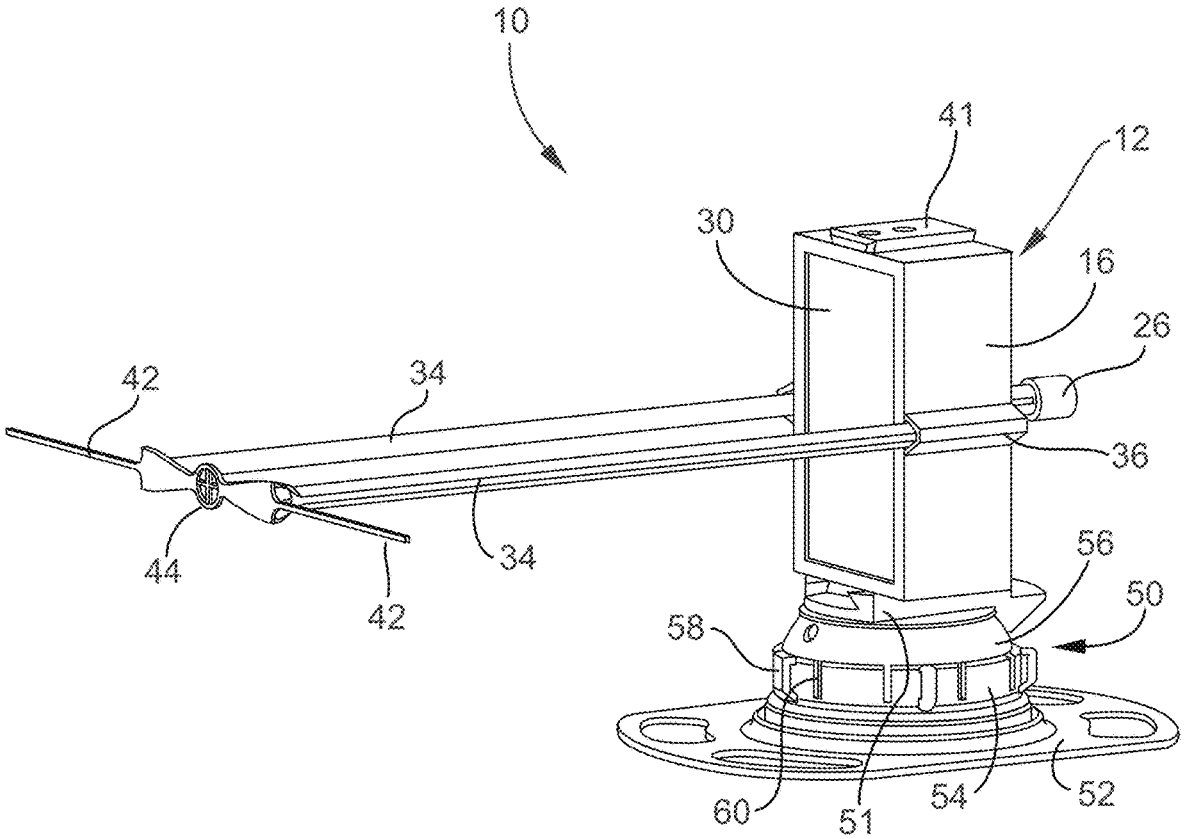
FIG. 8 is a perspective view of the tool of FIG. 2 with an exemplary embodiment of an articulating base.
Figure 9A:
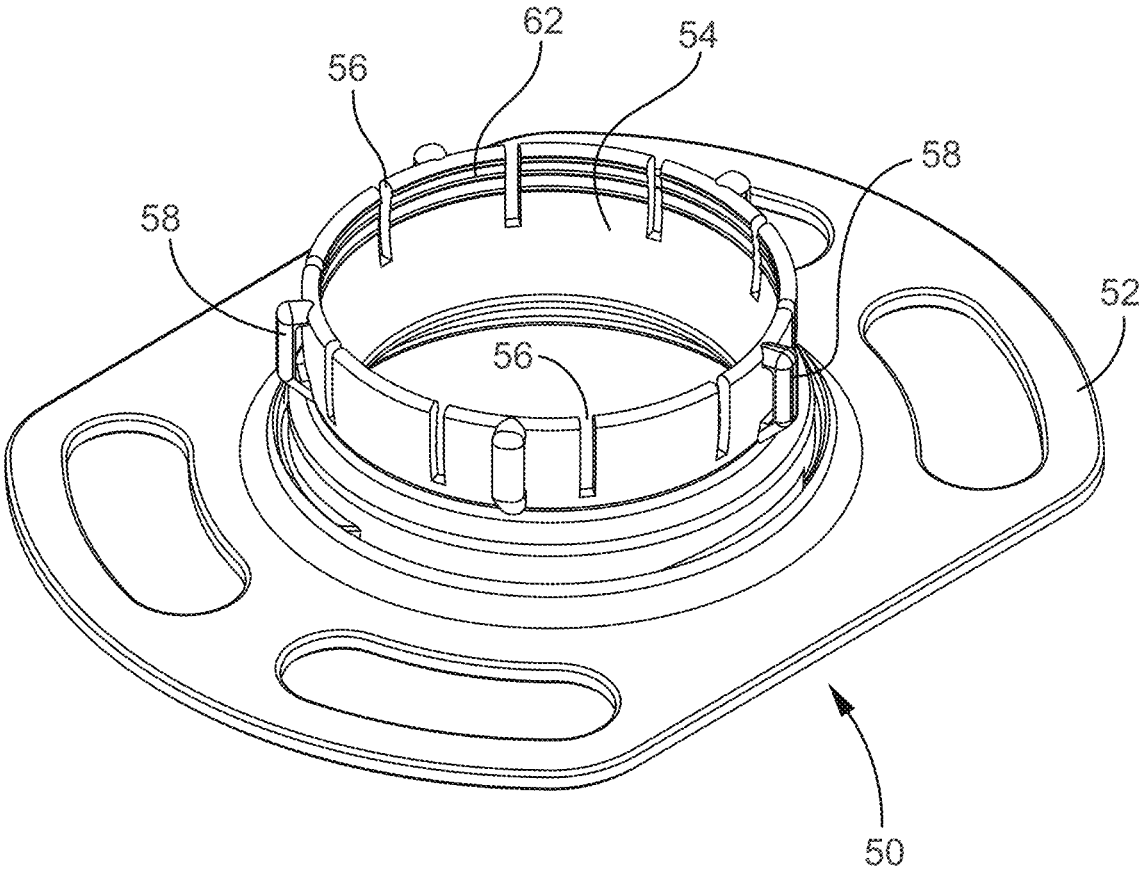
FIG. 9A is a perspective view of the bottom portion of the base of FIG. 8.
Figure 9B:
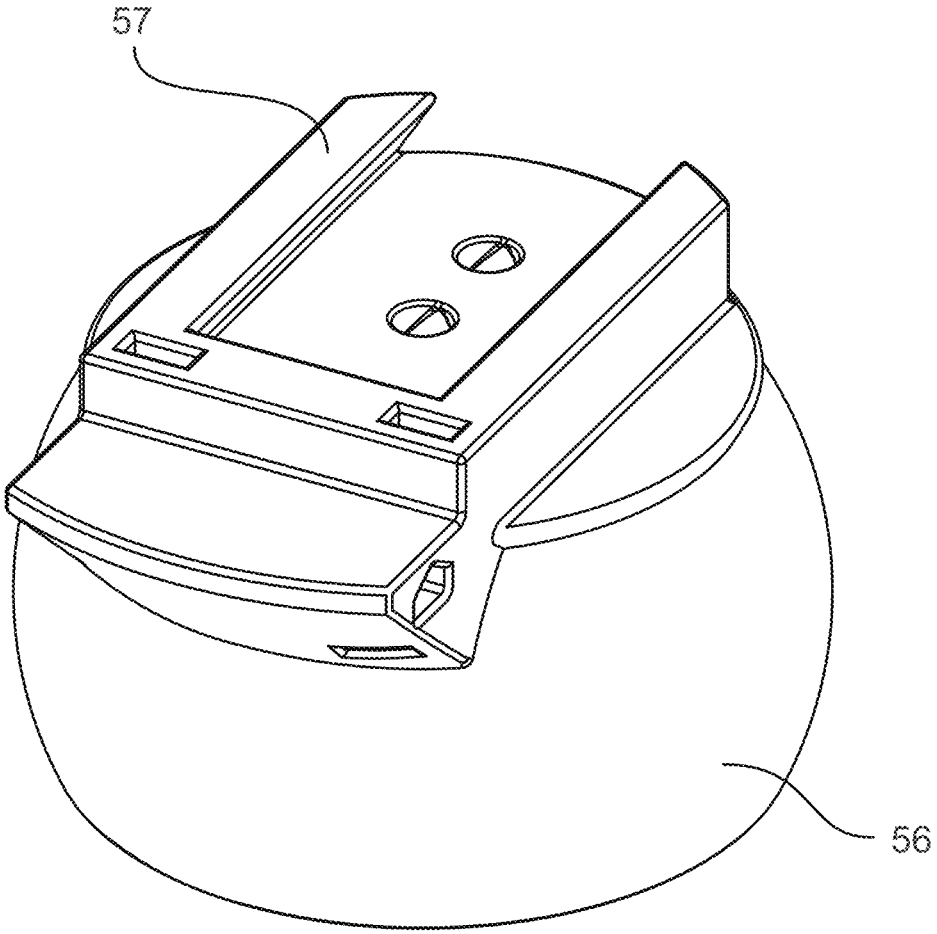
FIG. 9B is a perspective view of the top portion of the base of FIG. 8.

A base interface 39 (FIG. 2) may be located on the bottom wall 24 of the housing 12. The base interface 39 may include one part of a dovetail joint. The base interface 39 may be joined to one of several types of bases 46, 48 or 50 (see FIGS. 4, 6, and 8, respectively). Bases 46, 48, and 50 share some features with the stand disclosed in U.S. Pat. No. 11,572,976 issued on Feb. 7, 2023 and entitled "Multiple Angle Pivoting Placement (MAPP) Stand." The entirety of U.S. Pat. No. 11,572,976 is expressly incorporated by reference herein. As seen in FIGS. 4 and 5, base 46 is a flat static base and includes on its top surface a part 47 of a dovetail joint for mating with the dovetail joint on base interface 39 (FIG. 2). As seen in FIGS. 6 and 7, base 48 is an angled static base and includes on its top surface a part 49 of a dovetail joint for mating with the dovetail joint on base interface 39. The dovetail joint part 49 is angled so that housing 12 will be at a fixed angle with respect to the bottom surface of the base 48. The angle of dovetail joint part 49 may be varied by manufacturing different bases 48 using, for example, 3D printing. As seen in FIGS. 8, 9A and 9B, base 50 is an articulating base and includes on its top surface a part 51 of a dovetail joint for mating with the dovetail joint on base interface 39. Referring to FIGS. 9A and 9B, base 50 includes a ground-contacting bottom portion 52, a socket 54, and a ball 56. Socket 54 receives the ball 56 shown in FIG. 9B to form a friction fit so that the ball 56 may be rotated or angled in the socket 54 as needed to aim the tool 10. The ball 56 includes the dovetail joint portion 51 that interfaces with the dovetail joint portion on base interface 39 on the bottom wall 24 of the housing 12. The fit between the ball 56 and socket 54 may be, for example, pre-adjusted by an optional clamp (not shown), such as a zip tie, which is disposed around the exterior of the socket and passes through loops 58 on the socket. Optional rubber grips (not shown) may be placed in slots 60 in the socket 54. An optional friction grip 62 may be disposed on the interior circumference of the socket 54. The bases 46, 48, 50 may be configured to contact the ground surface and stably support the tool 10 so that the tool does not tip over prior to detonation of the quantity of C-4 explosive 28.

Figure 10:
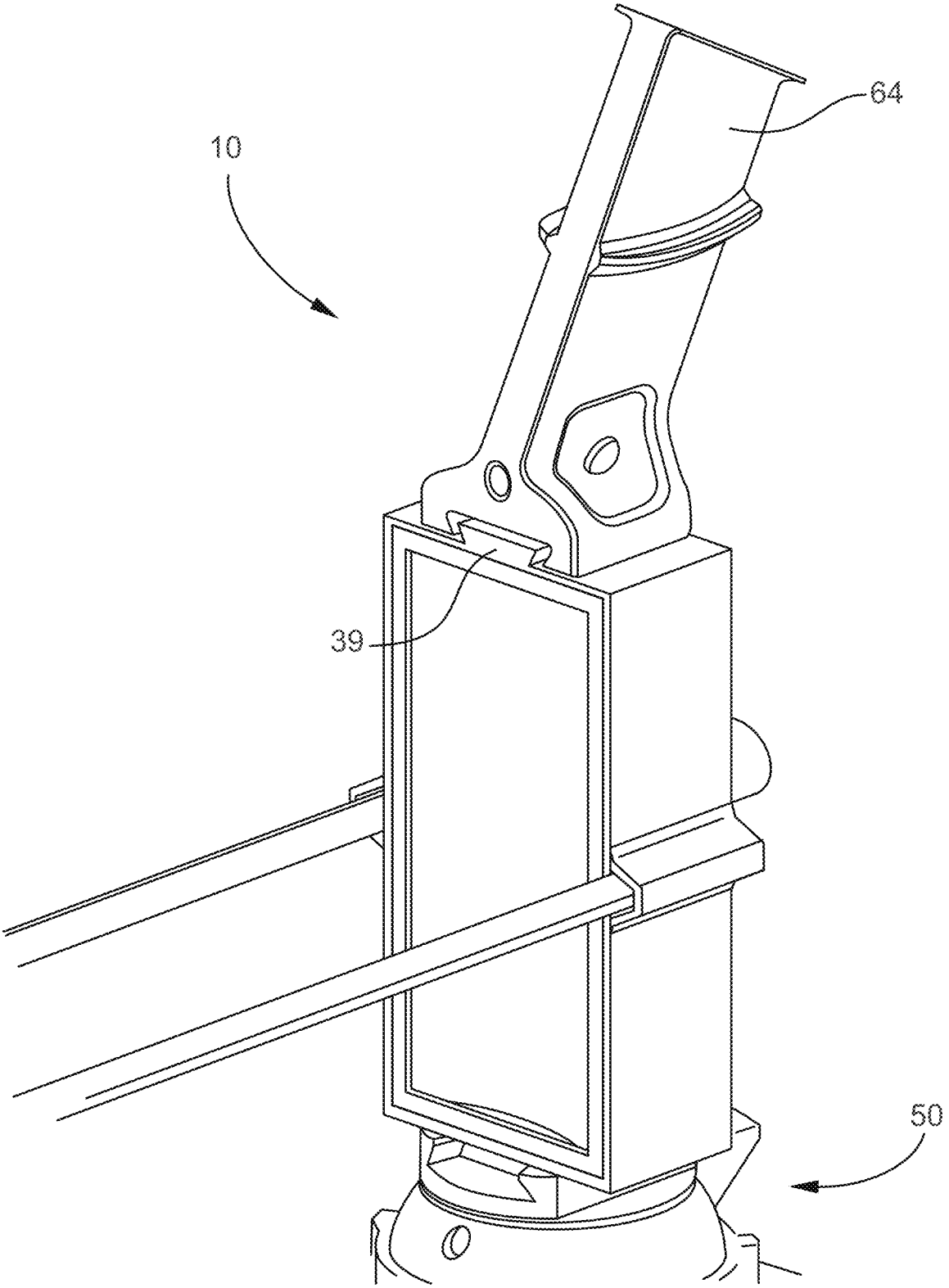
FIG. 10 is a partial perspective view of the tool of FIG. 2 with an exemplary embodiment of an inline ground robot grip.
Figure 11:
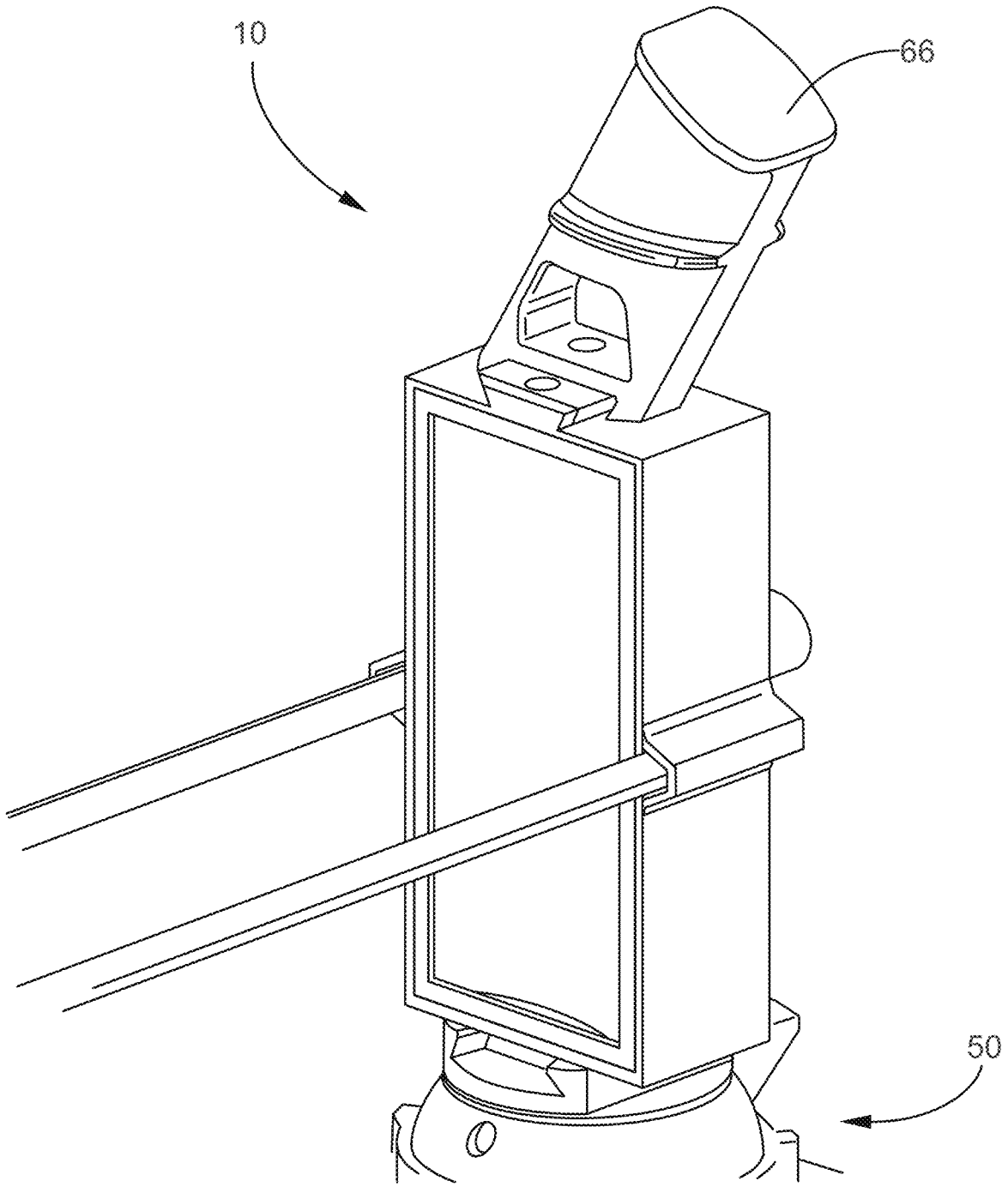
FIG. 11 is a partial perspective view of the tool of FIG. 2 with an exemplary embodiment of a sideways ground robot grip.
Figure 12:
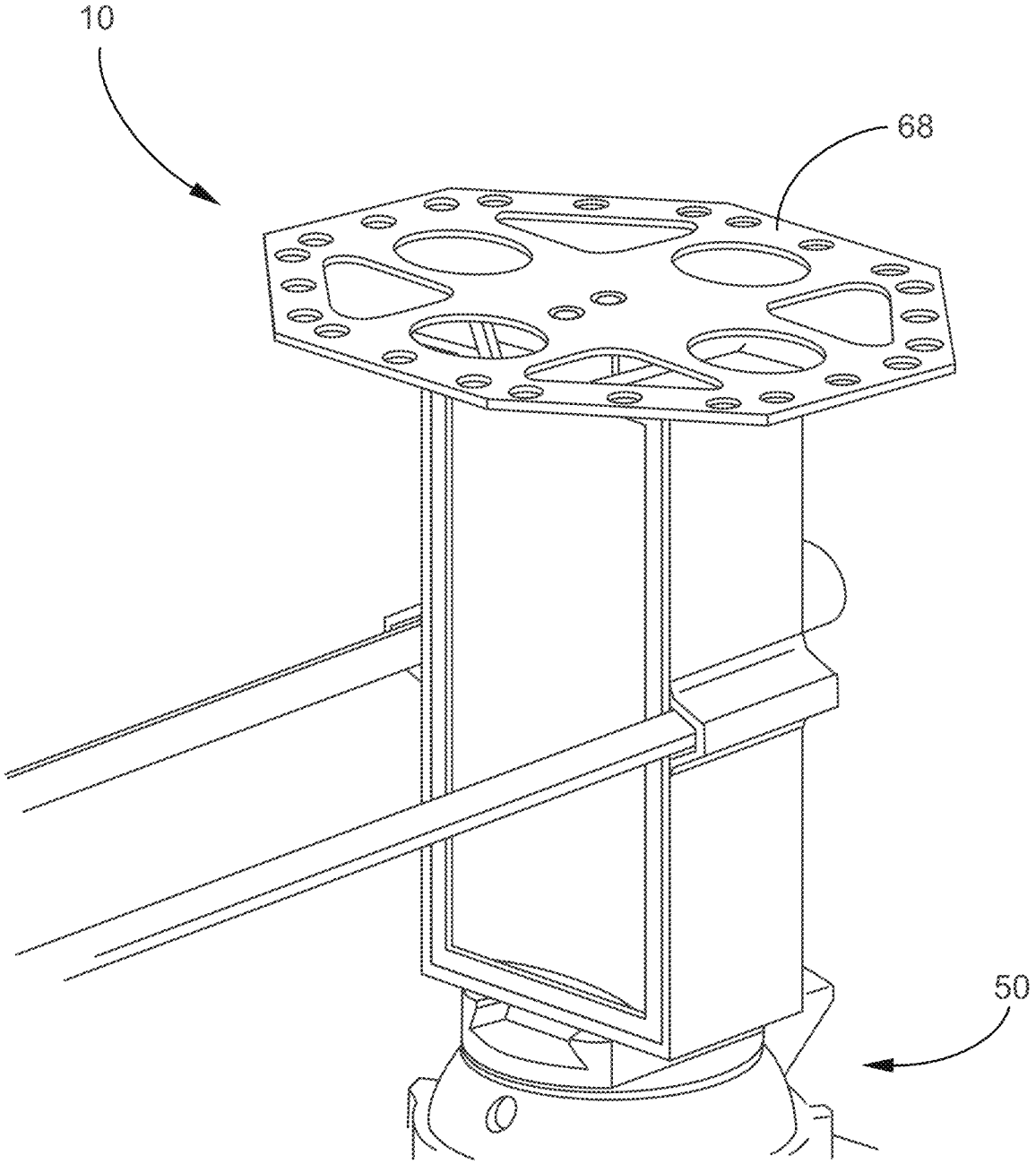
FIG. 12 is a partial perspective view of the tool of FIG. 2 with an exemplary embodiment of an unmanned aerial vehicle grip.

Referring to FIG. 2, an unmanned vehicle interface 41 may be attached to the top wall 22 of the housing 12 for interfacing with an unmanned vehicle grip. The unmanned vehicle interface 41 may include one part of a dovetail joint. The unmanned vehicle interface 41 may be joined to one of several types of unmanned vehicle grips. The unmanned vehicle grips may include another part of a dovetail joint for joining to the unmanned vehicle interface 41. An unmanned vehicle attaches to the unmanned vehicle grip to transport the tool 10 to a location of use of the tool. The unmanned vehicle grips may include, for example, an inline ground robot grip 64 (FIG. 10); a sideways ground robot grip 66 (FIG. 11); and an unmanned aerial vehicle grip 68 (FIG. 12). A system of lines (not shown) may be attached to the unmanned aerial vehicle grip 68 and in turn may be attached to the unmanned aerial vehicle (not shown).

Figure 13:
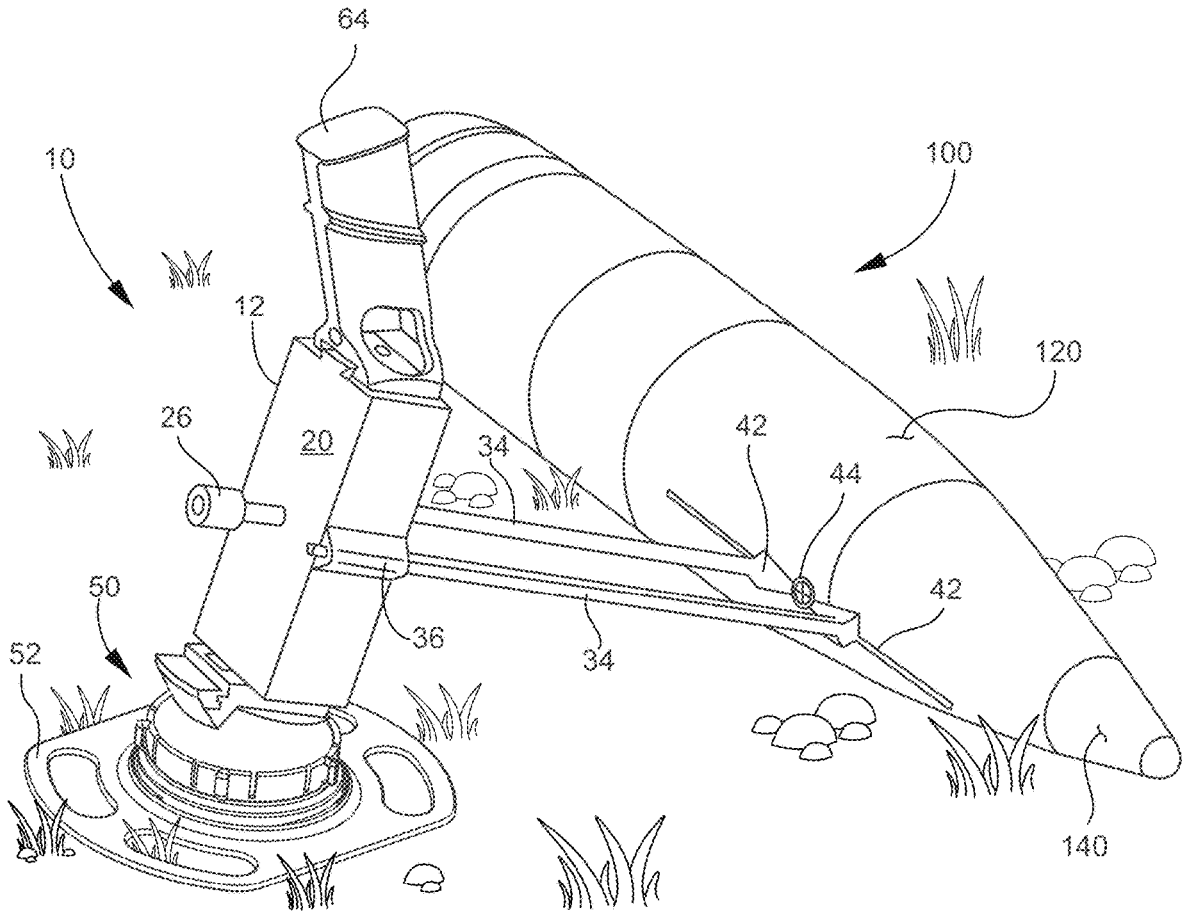
FIG. 13 is a perspective view of the tool of FIG. 2 in position to fire a linear explosively formed projectile at an unexploded 155 mm projectile.
Figure 14:
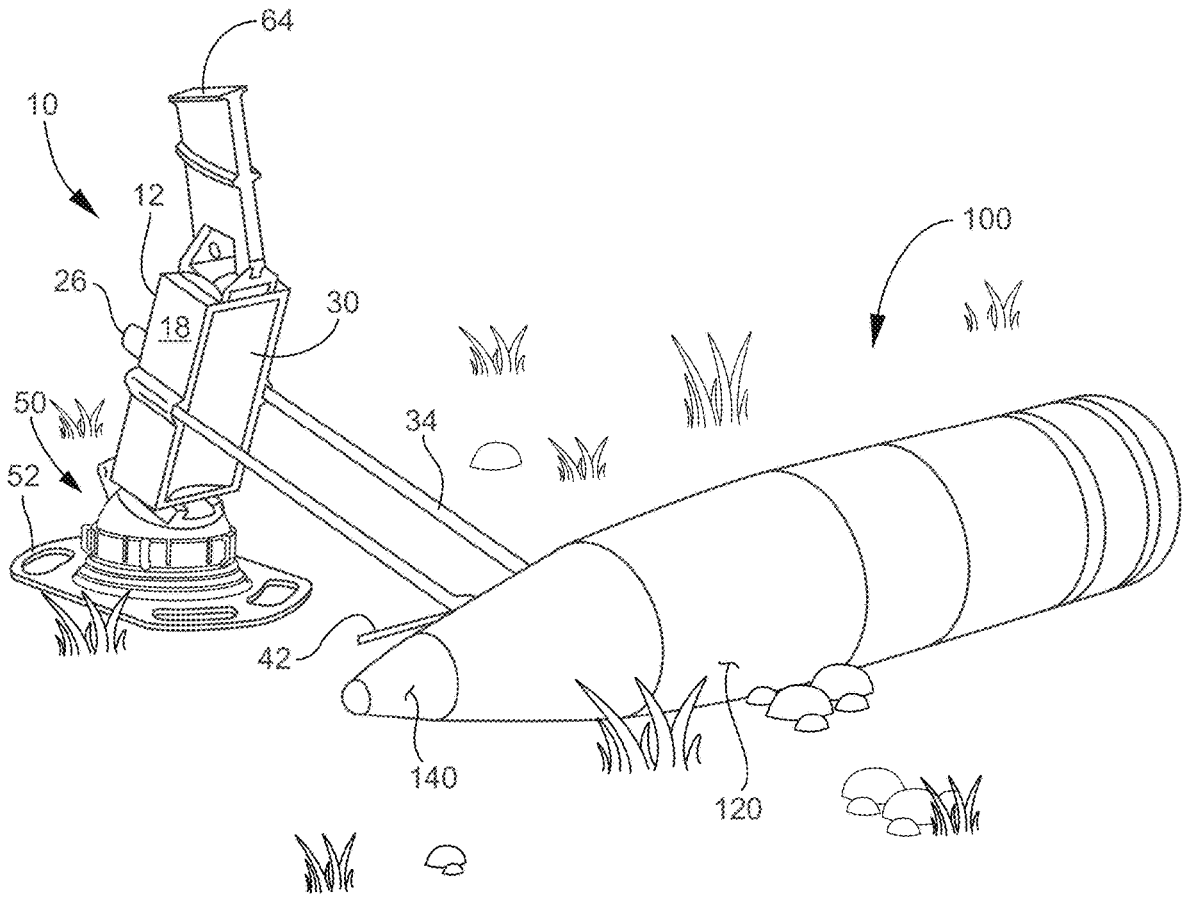
FIG. 14 is another perspective view of FIG. 13.

FIG. 13 is a perspective view of the tool 10 of FIG. 2 in position to fire a linear explosively formed projectile at an unexploded 155 mm projectile 100. FIG. 14 is another perspective view of FIG. 13. The tool 10 of FIGS. 13 and 14 includes the inline ground robot grip 64 and the articulating base 50. The tool 10 has been aimed at the projectile 100 using the unmanned vehicle (not shown) that transported the tool to the area adjacent to the projectile. The visual indicator 40 of the stand-off wands 34 includes whiskers 42 and a reticle 44. Initiation of a detonator in the detonator well 26 causes the quantity of C-4 explosive 28 to explode and explosively transform the copper liner 30 into a Linear Explosively Formed Projectile (LEFP). The LEFP penetrates the steel casing 120 of the projectile 100 and separates the fuze components 140 from the main explosive charge 130. The process of dismembering the fuze components 140 occurs without setting off or detonating the main charge 130. Even if the separated fuze components 140 may explosively function or still be unexploded and not safe to handle, the separated fuze components cannot set off the main charge 130 and cause further hazard.

Actual Test Results

First test: The remote explosive separation tool successfully cut inert fuze components from an inert 155 mm projectile.

Second test: The remote explosive separation tool successfully cut inert fuze components from a live 155 mm projectile.

Third test: The remote explosive separation tool successfully cut live, armed, unexploded fuze components from a live 155 mm projectile containing IMX-101 as the main charge.

Fourth test: The remote explosive separation tool successfully cut live, armed, unexploded fuze components from a live 155 mm projectile containing TNT as the main charge.

Finally, any numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A remote explosive separation tool for forming a Linear Explosively Formed Projectile (LEFP), comprising:

a housing in the shape of a rectangular prism, the housing includes an open front, two opposing side walls, a rear wall, and top and bottom walls;

a detonator well being located on the housing;

a quantity of C-4 explosive being packed in the housing and extending from the top wall to the bottom wall;

a linear concave copper liner being disposed adjacent to the quantity of C-4 explosive and extending from the top wall to the bottom wall, the linear concave copper liner faces the open front of the housing and includes an elliptical cross-section;

a pair of parallel stand-off wands extending from respective opposing side walls midway between the top and bottom walls, the pair of parallel stand-off wands extends perpendicular to a plane of the open front and includes, at distal ends, visual indicators for identifying a point of impact of the LEFP;

a base interface being attached to the bottom wall of the housing for attaching the housing to a base, the base being configured to contact a ground surface and stably support the tool so that the tool does not tip over prior to detonation of the quantity of C-4 explosive; and an unmanned vehicle interface being attached to the top wall of the housing for attaching the tool to an unmanned vehicle grip.

2. The remote explosive separation tool of claim 1, wherein the point of impact of the LEFP corresponds to a projection of a geometric center of the open front of the housing to a second point that is midway between the distal ends of the stand-off wands.

3. The remote explosive separation tool of claim 1, wherein the housing is a plastic housing.

4. The remote explosive separation tool of claim 1, wherein the base interface includes one part of a dovetail joint and the base includes another part of a dovetail joint.

5. The remote explosive separation tool of claim 1, wherein the quantity of C-4 explosive is about 1.25 pounds.

6. The remote explosive separation tool of claim 4, wherein the unmanned vehicle interface includes one part of a dovetail joint and the unmanned vehicle grip includes another part of the dovetail joint.

7. The remote explosive separation tool of claim 1, wherein the unmanned vehicle grip is one of an inline ground robot grip, a sideways ground robot grip, and an unmanned aerial vehicle grip.

8. The remote explosive separation tool of claim 1, wherein the base is one of a flat static stand, an angled static stand, and an articulating stand.

9. The remote explosive separation tool of claim 1, further comprising a pair of wand holder sleeves being located on respective opposing side walls of the housing, wherein proximal ends of the pair of parallel stand-off wands are disposed in respective ones of the pair of wand holder sleeves.

10. The remote explosive separation tool of claim 9, wherein the visual indicators at the distal ends of the pair of parallel stand-off wands include whiskers and a bullseye.

11. A method of separating fuzing components from a main charge in unexploded ordnance (UXO), comprising:

providing the remote explosive separation tool of claim 1;

creating a Linear Explosively Formed Projectile (LEFP) from the linear concave copper liner having the elliptical cross-section; and directing the LEFP at the UXO and separating the fuzing components from the main charge without at least one of setting off and detonating the main charge.

12. The method of claim 11, further comprising transporting the remote explosive separation tool to a location near the UXO, using an unmanned vehicle.

13. The method of claim 12, further comprising, using the unmanned vehicle, aiming the remote explosive separation tool at the UXO.

14. The method of claim 12, further comprising, using the unmanned vehicle, aiming the remote explosive separation tool at the UXO, wherein the UXO includes a steel casing, and wherein the Linear Explosively Formed Projectile (LEFP) penetrates the steel casing.

15. The method of claim 12, further comprising, using the unmanned vehicle, aiming the remote explosive separation tool at the UXO, wherein the UXO includes a steel casing, wherein the Linear Explosively Formed Projectile (LEFP) penetrates the steel casing, wherein the UXO is a 155 mm projectile.

16. A remote explosive separation tool for forming a Linear Explosively Formed Projectile (LEFP), comprising:

a housing including an open front, two opposing side walls, a rear wall, and top and bottom walls;

a quantity of C-4 explosive being packed in the housing;

a linear concave copper liner being disposed adjacent to the quantity of C-4 explosive, the linear concave copper liner faces the open front of the housing and includes an elliptical cross-section;

a pair of parallel stand-off wands extending from respective opposing side walls, the pair of parallel stand-off wands includes at distal ends, visual indicators to identify a point of impact of the LEFP;

a base being attached to the bottom wall of the housing, the base is configured to contact a ground surface and stably support the tool so that the tool does not tip over prior to detonation of the quantity of C-4 explosive; and an unmanned vehicle interface being attached to the top wall of the housing for attaching the tool to an unmanned vehicle grip.

17. The remote explosive separation tool of claim 16, further comprising a pair of wand holder sleeves being located on the respective opposing side walls of the housing, wherein proximal ends of the pair of parallel stand-off wands are disposed in respective ones of the pair of wand holder sleeves.

18. The remote explosive separation tool of claim 17, wherein a proximal end of each stand off wand includes a barb that contacts the rear surface of the housing.

19. The remote explosive separation tool of claim 16, wherein the base is one of a flat static stand, an angled static stand, and an articulating stand.

20. The remote explosive separation tool of claim 16, wherein the unmanned vehicle interface includes an unmanned vehicle grip for one of an inline ground robot, a sideways ground robot, and an unmanned aerial vehicle.

* * * * *